US008241560B2

(12) United States Patent
Corrigan et al.

(10) Patent No.: US 8,241,560 B2
(45) Date of Patent: Aug. 14, 2012

(54) NICKEL BASE SUPERALLOY AND SINGLE CRYSTAL CASTINGS

(75) Inventors: John Corrigan, Yorktown, VA (US); Michael G. Launsbach, Yorktown, VA (US); John R. Mihalisin, North Caldwell, NJ (US)

(73) Assignee: Howmet Corporation, Independence, OH (US)

( * ) Notice: Subject to any disclaimer, the term of this patent is extended or adjusted under 35 U.S.C. 154(b) by 645 days.

(21) Appl. No.: 10/424,589

(22) Filed: Apr. 28, 2003

(65) Prior Publication Data

US 2004/0213693 A1 Oct. 28, 2004

(51) Int. Cl.
*C22C 19/05* (2006.01)

(52) U.S. Cl. ..... 420/448; 420/444; 420/442

(58) Field of Classification Search ..... 148/404, 148/428; 420/441–460
See application file for complete search history.

(56) References Cited

U.S. PATENT DOCUMENTS

| | | | | |
|---|---|---|---|---|
| 3,763,926 | A | 10/1973 | Tschinkel et al. | 164/338 |
| 4,190,094 | A | 2/1980 | Giamei | 164/60 |
| 4,643,782 | A | 2/1987 | Harris et al. | 148/404 |
| 4,719,080 | A | 1/1988 | Duhl et al. | 420/443 |
| 5,100,484 | A * | 3/1992 | Wukusick et al. | 148/562 |
| 5,549,765 | A | 8/1996 | Mihalisin et al. | 148/428 |
| 5,759,301 | A | 6/1998 | Konter et al. | 148/404 |
| 5,888,451 | A | 3/1999 | Konter et al. | 420/448 |
| 6,074,602 | A | 6/2000 | Wukusick et al. | 420/443 |
| 6,419,763 | B1 * | 7/2002 | Konter et al. | 148/404 |
| 6,652,982 | B2 * | 11/2003 | Spitsberg et al. | 428/472.2 |
| 2002/0007877 | A1 | 1/2002 | Mihalisin et al. | |

OTHER PUBLICATIONS

U.S. Appl. No. 10/734 078, filed Dec. 11, 2003 entitled Nickel Base Superalloy.
U.S. Appl. No. 10/831,978, filed Apr. 26, 2004 entitled Nickel Base Superalloy and Single Crystal Castings.
Superalloys, A Technical Guide, Second Edition, Matthew J. Donachie and Stephen J. Donachie, Chapter 5, Investment Casting (11 sheets).
Mechanical Metallurgy, Second Edition, © 1961, Prediction of Long-Time Properties, (8 sheets).

* cited by examiner

*Primary Examiner* — Roy King
*Assistant Examiner* — Christopher Kessler

(57) ABSTRACT

A single crystal nickel base superalloy consists essentially of, in weight %, about 6.4% to about 6.8% Cr, about 9.3% to about 10.0% Co, above 6.7% to about 8.5% Ta, about 5.45% to about 5.75% Al, about 6.2% to about 6.6% W, about 0.5% to about 0.7% Mo, about 0.8% to about 1.2% Ti, about 2.8% to about 3.2% Re, up to about 0.12% Hf, about 0.01% to about 0.08% by weight C, up to about 0.10% B, and balance Ni and incidental impurities. The superalloy provides improved alloy cleanliness and castability while providing improved high temperature mechanical properties such as stress rupture life.

5 Claims, 7 Drawing Sheets

NICKEL BASE SUPERALLOY AND SINGLE CRYSTAL CASTINGS

FIELD OF THE INVENTION

The present invention relates to a nickel base superalloy and to single crystal castings, such as single crystal airfoil castings, made from the superalloy.

BACKGROUND OF THE INVENTION

Superalloys are widely used as castings in the gas turbine engine industry for critical components, such as turbine airfoils including blades and vanes, subjected to high temperatures and stress levels. Such critical components oftentimes are cast using well known directional solidification (DS) techniques that provide a single crystal microstructure or columnar grain microstructure to optimize properties in one or more directions.

Directional solidification casting techniques are well known wherein a nickel base superalloy remelt ingot is vacuum induction remelted in a crucible in a casting furnace and poured into a ceramic investment cluster mold disposed in the furnace having a plurality of mold cavities. During directional solidification, the superalloy melt is subjected to unidirectional heat removal in the mold cavities to produce a columnar grain structure or single crystal in the event a crystal selector or seed crystal is incorporated in the mold cavities. Unidirectional heat removal can be effected by the well known mold withdrawal technique wherein the melt-filled cluster mold on a chill plate is withdrawn from the casting furnace at a controlled rate. Alternately, a power down technique can be employed wherein induction coils disposed about the melt-filled cluster mold on the chill plate are de-energized in controlled sequence. Regardless of the DS casting technique employed, generally unidirectional heat removal is established in the melt in the mold cavities.

Since single crystal castings do not include grain boundaries, prior art workers believed that elements, such as carbon and boron, that from grain boundary strengthening precipitates in the microstructure would not be necessary in single crystal superalloy compositions.

However, U.S. Pat. No. 5,549,765 describes a nickel base superalloy having increased carbon concentration to produce a cleaner casting. Although the nickel base superalloy of the '765 patent improves alloy cleanliness and castability, a reduction in mechanical properties, such as stress rupture life, at elevated temperatures, such as at and above 1400° F., has been observed in laboratory testing.

SUMMARY OF THE INVENTION

The present invention provides a nickel base superalloy consisting essentially of, in weight %, about 6.4% to about 6.8% Cr, about 9.3% to about 10.0% Co, above 6.7% to about 8.5% Ta, about 5.45% to about 5.75% Al, about 6.2% to about 6.6% W, about 0.5% to about 0.7% Mo, about 0.8% to about 1.2% Ti, about 2.8% to about 3.2% Re, up to about 0.12% Hf, about 0.01% to about 0.08% C, up to about 0.10% B, and balance Ni and incidental impurities.

The concentrations of carbon and tantalum preferably are controlled in the ranges of 0.01% to 0.08% by weight C and 6.8% to 8.5% by weight Ta, more preferably 7.0% to about 8.5% by weight Ta, to provide a nickel base superalloy with improved alloy cleanliness and castability, while at the same time providing improved mechanical properties, such as stress rupture life, at elevated temperatures of 1400° F. and above.

A nickel base superalloy having a nominal composition pursuant to the invention consists essentially of, by weight, about 6.6% Cr, about 9.6% Co, about 7.3% Ta, about 5.6% Al, about 6.4% W, about 0.6% Mo, about 1.0% Ti, about 3.0% Re, about 0.10% Hf, about 0.04% C, about 0.005% B, and balance Ni and incidental impurities.

Advantages, features, and embodiments of the present invention will become apparent from the following description.

DESCRIPTION OF THE INVENTION

Figure 1:
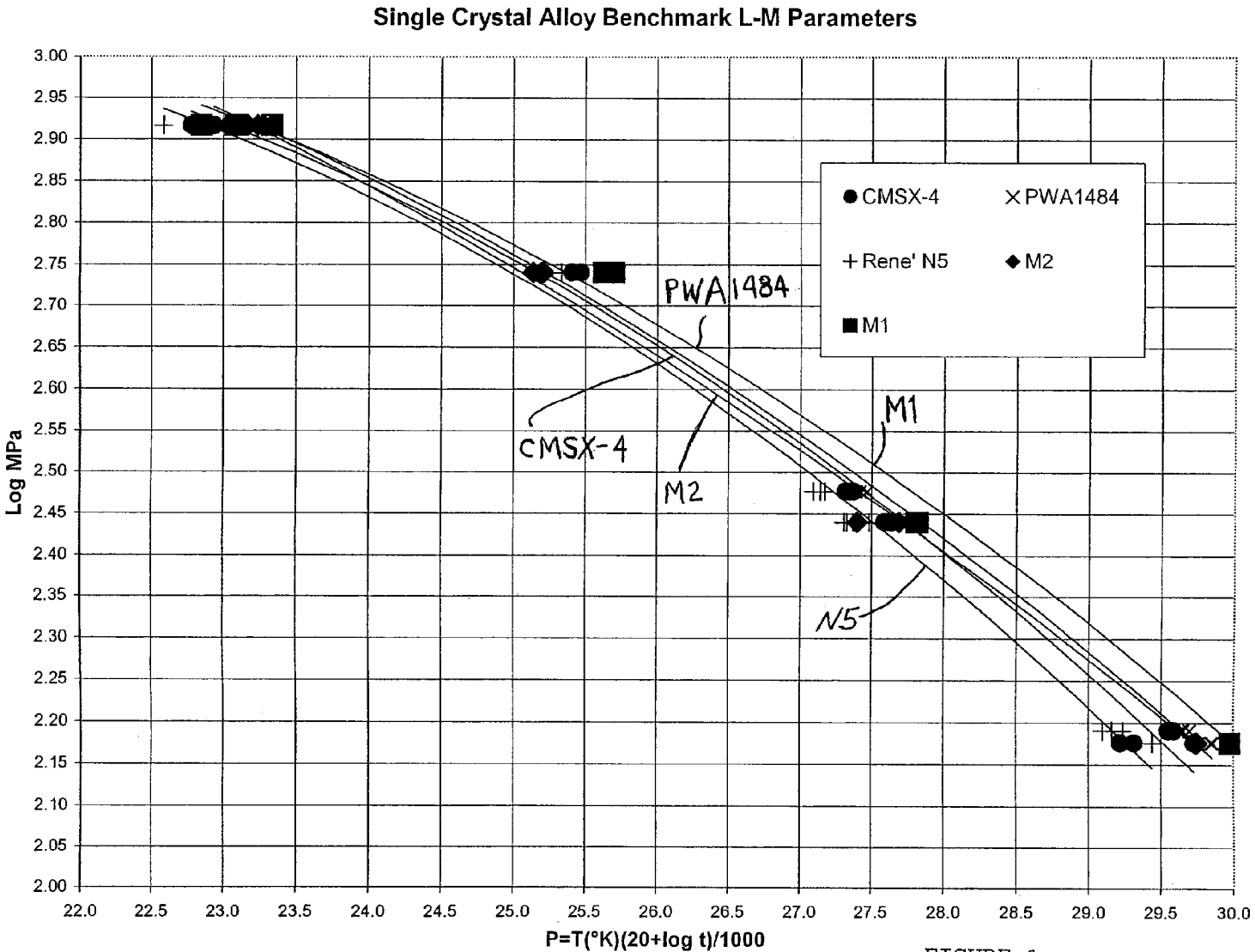
FIG. 1 is a graph representing the Larson-Miller parameter for CMSX-M1 and CMSX-M2 nickel base superalloys pursuant to the invention and for the comparison PWA 1484, N5, and CMSX-4 nickel base superalloys.

The present invention provides a nickel base superalloy which is useful in directional solidification processes to make single crystal gas turbine engine components subjected to high temperatures and stress levels, such as single crystal turbine airfoils including blades and vanes, although the invention is not limited to use to make such components.

Pursuant to an embodiment of the invention, the nickel base superalloy and single crystal castings made therefrom consists essentially of, in weight %, about 6.4% to about 6.8% Cr, about 9.3% to about 10.0% Co, above 6.7% to about 8.5% Ta, about 5.45% to about 5.75% Al, about 6.2% to about 6.6% W, about 0.5% to about 0.7% Mo, about 0.8% to about 1.2% Ti, about 2.8% to about 3.2% Re, up to about 0.12% Hf, 0.01% to 0.08% C (about 100 to about 800 ppm by weight C), up to about 0.10% B, and balance Ni and incidental impurities. Hafnium may be in the range of 0.07 to 0.12 weight 6. The superalloy can include at least one of yttrium, cerium, and lanthanum in an amount up to about 0.01 weight % to improve oxidation and/or corrosion resistance of the superalloy.

In practice of the present invention, the concentrations of both carbon and tantalum preferably are controlled within the ranges of about 0.02% to about 0.04% by weight C and 6.8% to about 8.5% by weight Ta, more preferably 7.0% to about 8.5% by weight Ta, to impart improved alloy cleanliness and castability, while at the same time providing dramatically improved mechanical properties, such as stress rupture life, at elevated temperatures of 1400° F. and above.

Single crystal test bars for mechanical property testing were cast using a superalloy pursuant to an embodiment of the invention designated CMSX-4 M1 having the nominal compositions, in weight %, about 6.6% Cr, about 9.6% Co, about 7.3% Ta, about 5.6% Al, about 6.4% W, about 0.6% Mo, about 1.0% Ti, about 3.0% Re, about 0.10% Hf, about 0.04% C, about 0.005% B, and balance Ni and incidental impurities. Other single crystal test bars for mechanical property testing were cast using a superalloy pursuant to another embodiment of the invention designated CMSX-4 M2 having the nominal composition, in weight %, about 6.6% Cr, about 9.6% Co, about 6.8% Ta, about 5.6% Al, about 6.4% W, about 0.6% Mo, about 1.0% Ti, about 3.0% Re, about 0.10% Hf, about 0.02% C, about 0.005% B, and balance Ni and incidental impurities. The single crystal test bars were made by casting the above-described CMSX-4 M1 and CMSX-M2 superalloys at a temperature of alloy melting point plus 350 degrees F. into a shell mold preheated to 2770 degrees F. The superalloys were solidified as single crystal test bars using the conventional directional solidification withdrawal technique and a pigtail crystal selector in the shell molds. Directional solidification processes for making single crystal castings are described in U.S. Pat. Nos. 3,700,023; 3,763,926; and 4,190,094.

Similar single crystal comparison test bars were made from known PWA 1484 nickel base superalloy, N5 nickel base superalloy, and CMSX-4 nickel base superalloy also using the conventional directional solidification withdrawal technique. These nickel base superalloys are in commercial use in the manufacture of single crystal airfoil castings for use in gas turbine engines. The PWA 1484 nickel base superalloy is described in U.S. Pat. No. 4,719,080; the N5 nickel base superalloy is described in U.S. Pat. No. 6,074,602; and the CMSX-4 nickel base superalloy is described in U.S. Pat. No. 4,643,782. The CMSX-4 nickel base superalloy limits carbon to a maximum of 60 ppm by weight.

The test bars were tested at different elevated temperatures for stress rupture resistance using test procedure ASTM E139 and tensile tested at room temperature and elevated temperatures for ultimate tensile strength (UTS), 0.2% yield strength, percent elongation, and reduction in area using ASTM test procedure ASTM E8 for room temperature tests and ASTM E21 for elevated temperatures.

Figure 2:
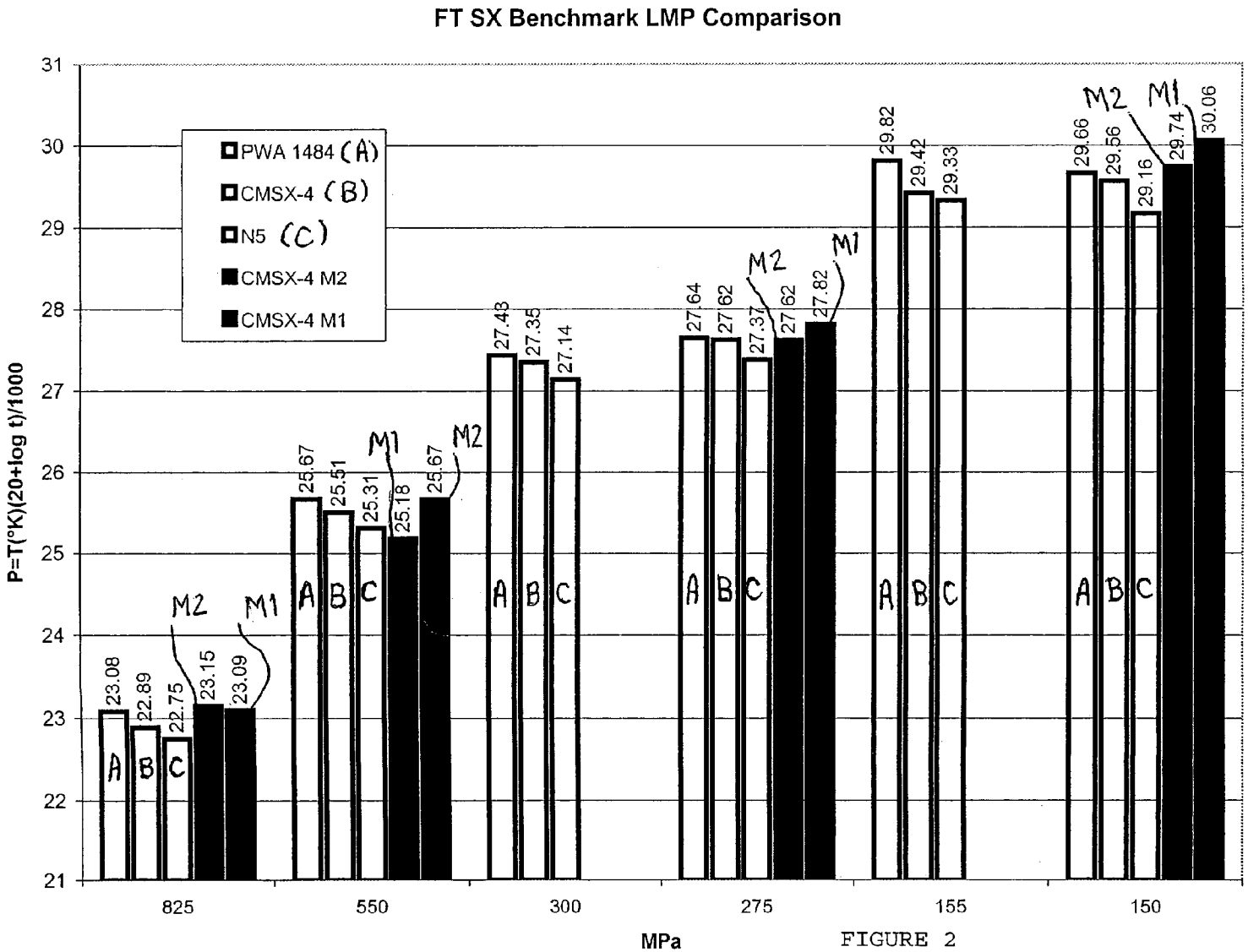
FIG. 2 is a bar graph representing the Larson-Miller parameter at different stress test levels for CMSX-M1 nickel base superalloy (designated M1) and CMSX-M2 nickel base superalloy (designated M2) pursuant to the invention and for the comparison PWA 1484 (designated A), CMSX-4 (designated B) and N5 (designated C) nickel base superalloys.

Referring to FIGS. 1 and 2, comparison of the Larson-Miller parameters for the CMSX-M1 and CMSX-M2 nickel base superalloys pursuant to the invention and the comparison PWA 1484, N5, and CMSX-4 nickel base superalloys is shown. The Larson-Miller parameter, P, is used to compare stress rupture characteristics of the nickel base superalloys shown in FIGS. 1 and 2. The Larson-Miller parameter is a time-temperature dependent parameter (P=T(°K) (20+log t)1000 where T is test temperature and t is time to rupture) widely used to extraplote stress rupture data as described in MECHANICAL METALLURGY, section 3-13, pages 483-486, Copyright 1961, 1976 by McGraw-Hill, Inc. FIGS. 1 and 2 reveal that the CMSX-M1 and CMSX-M2 nickel base superalloys pursuant to the invention are comparable to or better than the comparison nickel base superalloys in stress rupture resistance over the stress levels/temperatures tested (e.g. 791° C., 891° C., 991° C., and 1091° C. as shown in FIG. 3).

Figure 3:
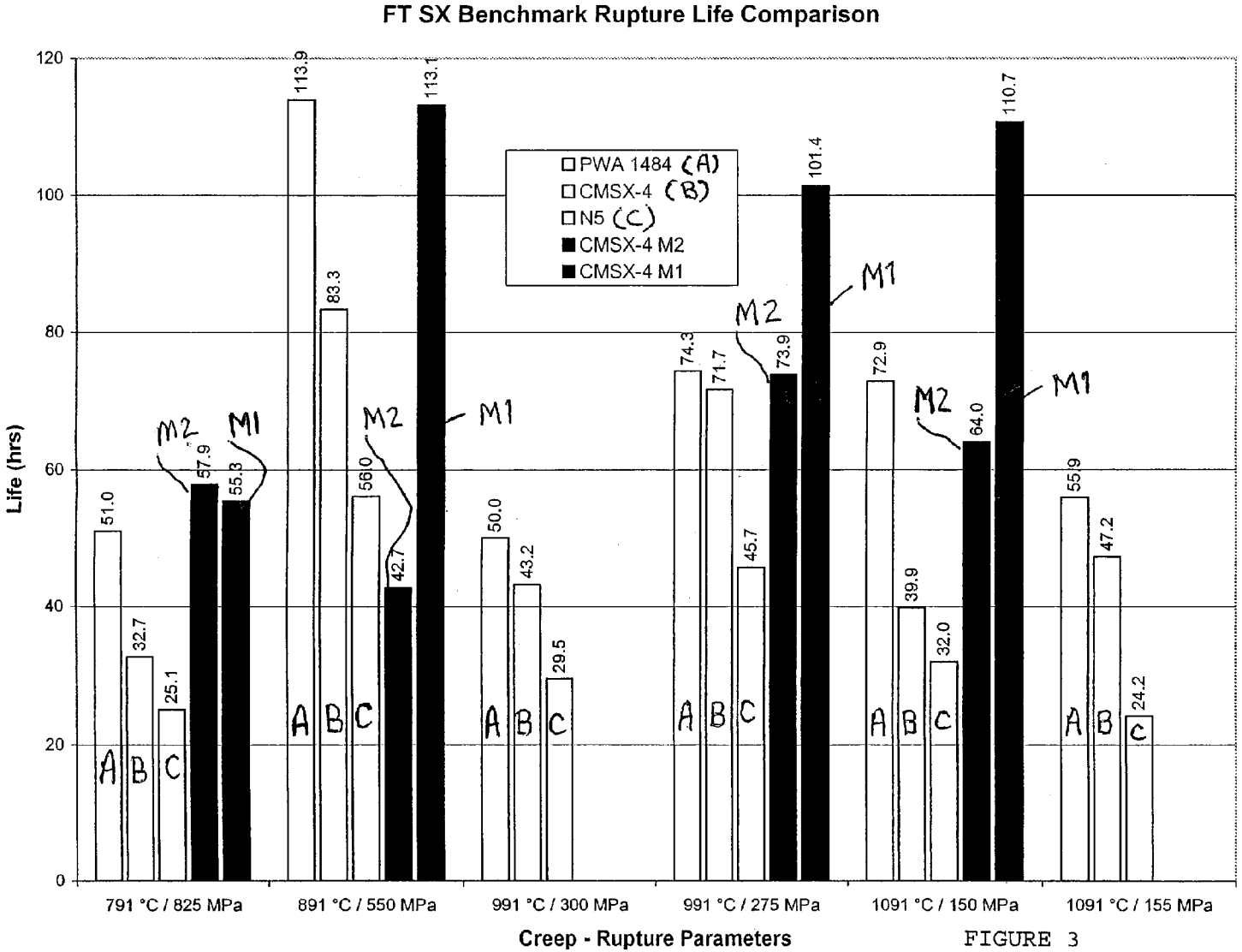
FIG. 3 is a bar graph showing the stress rupture life for for CMSX-M1 nickel base superalloy (designated M1) and CMSX-M2 nickel base superalloy (designated M2) pursuant to the invention and for the comparison PWA 1484 (designated A), CMSX-4 (designated B) and N5 (designated C) nickel base superalloys.
Figure 4:
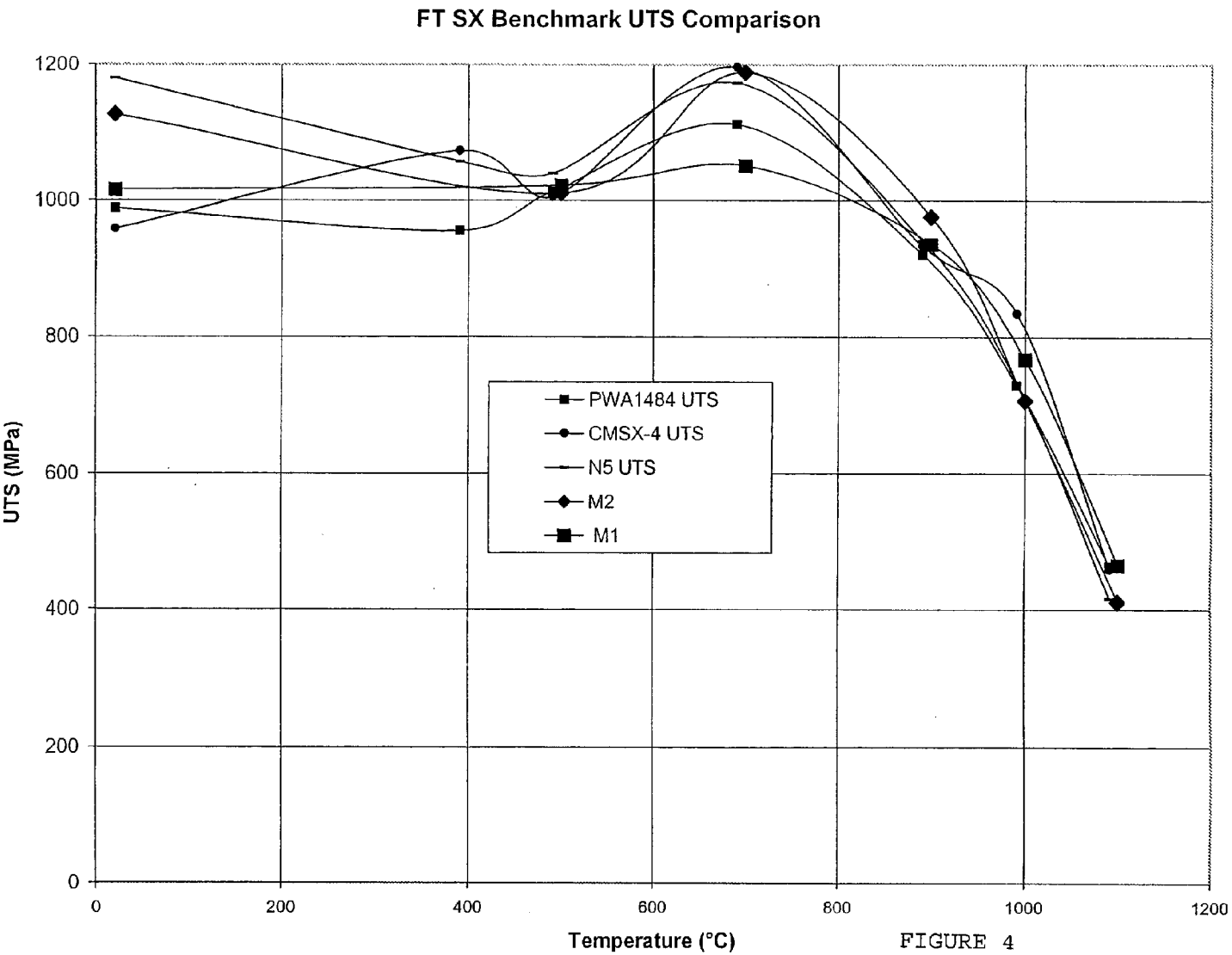
FIG. 4 is a graph of ultimate tensile strength (UTS) versus temperature for CMSX-M1 nickel base superalloy (designated M1) and CMSX-M2 nickel base superalloy (designated M2) pursuant to the invention and for the comparison PWA 1484, CMSX-4, and N5 nickel base superalloys.
Figure 5:
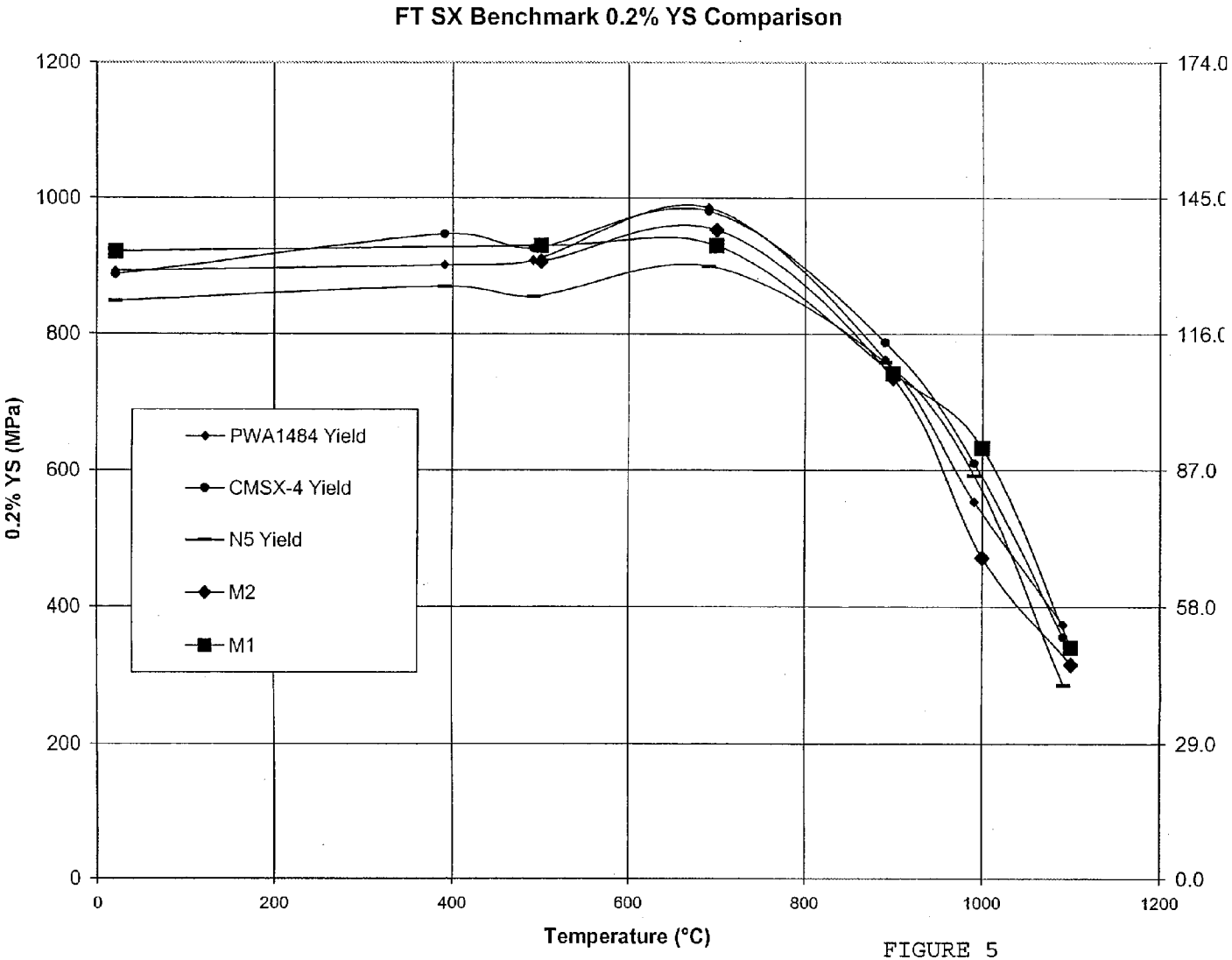
FIG. 5 is a graph of 0.2% yield stress versus temperature for CMSX-M1 nickel base superalloy (designated M1) and CMSX-M2 nickel base superalloy (designated M2) pursuant to the invention and for the comparison PWA 1484, N5, and CMSX-4 nickel base superalloys.
Figure 6:
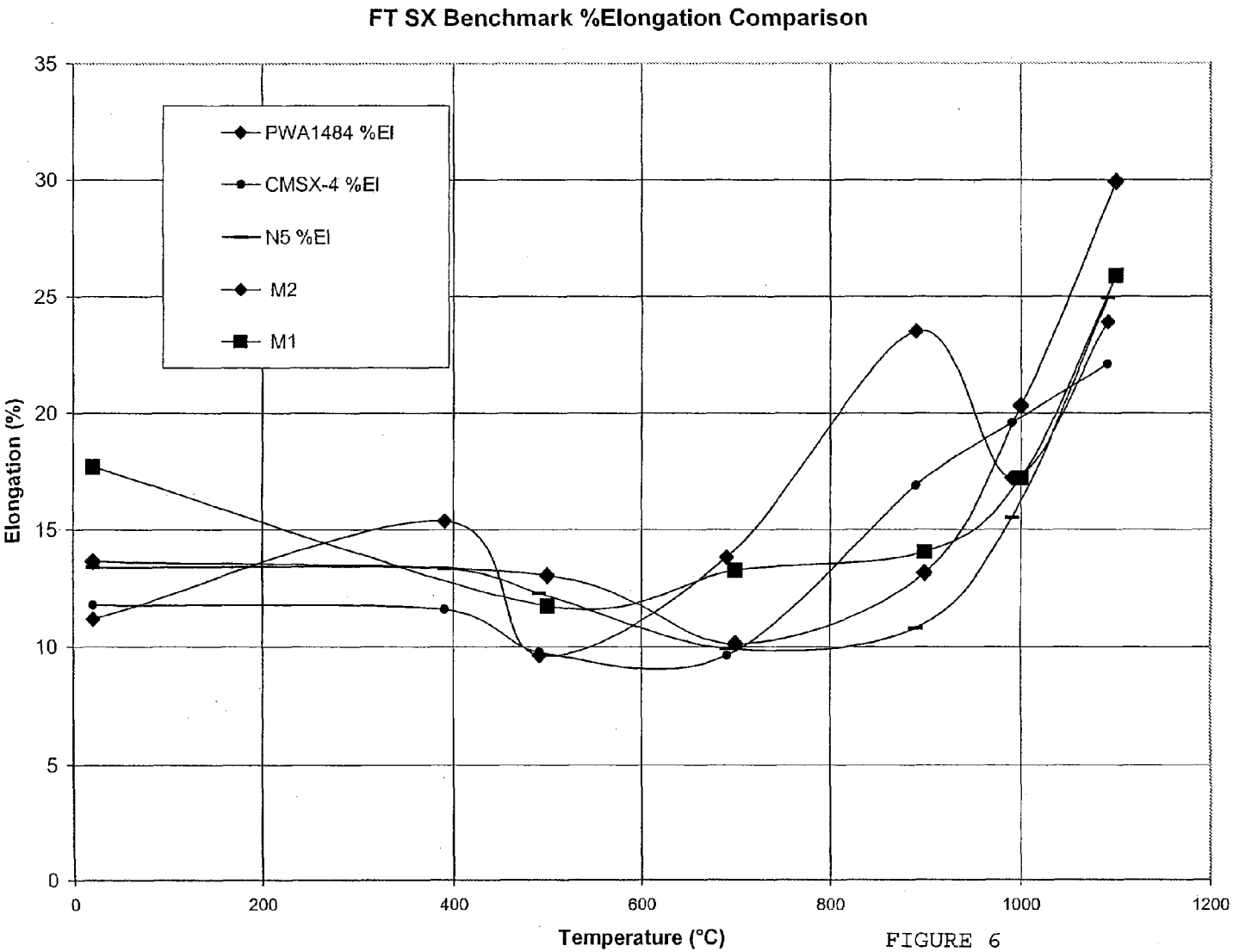
FIG. 6 is a graph of percent elongation versus temperature for CMSX-M1 nickel base superalloy (designated M1) and CMSX-M2 nickel base superalloy (designated M2) pursuant to the invention and for the comparison PWA 1484, N5, and CMSX-4 nickel base superalloys.
Figure 7:
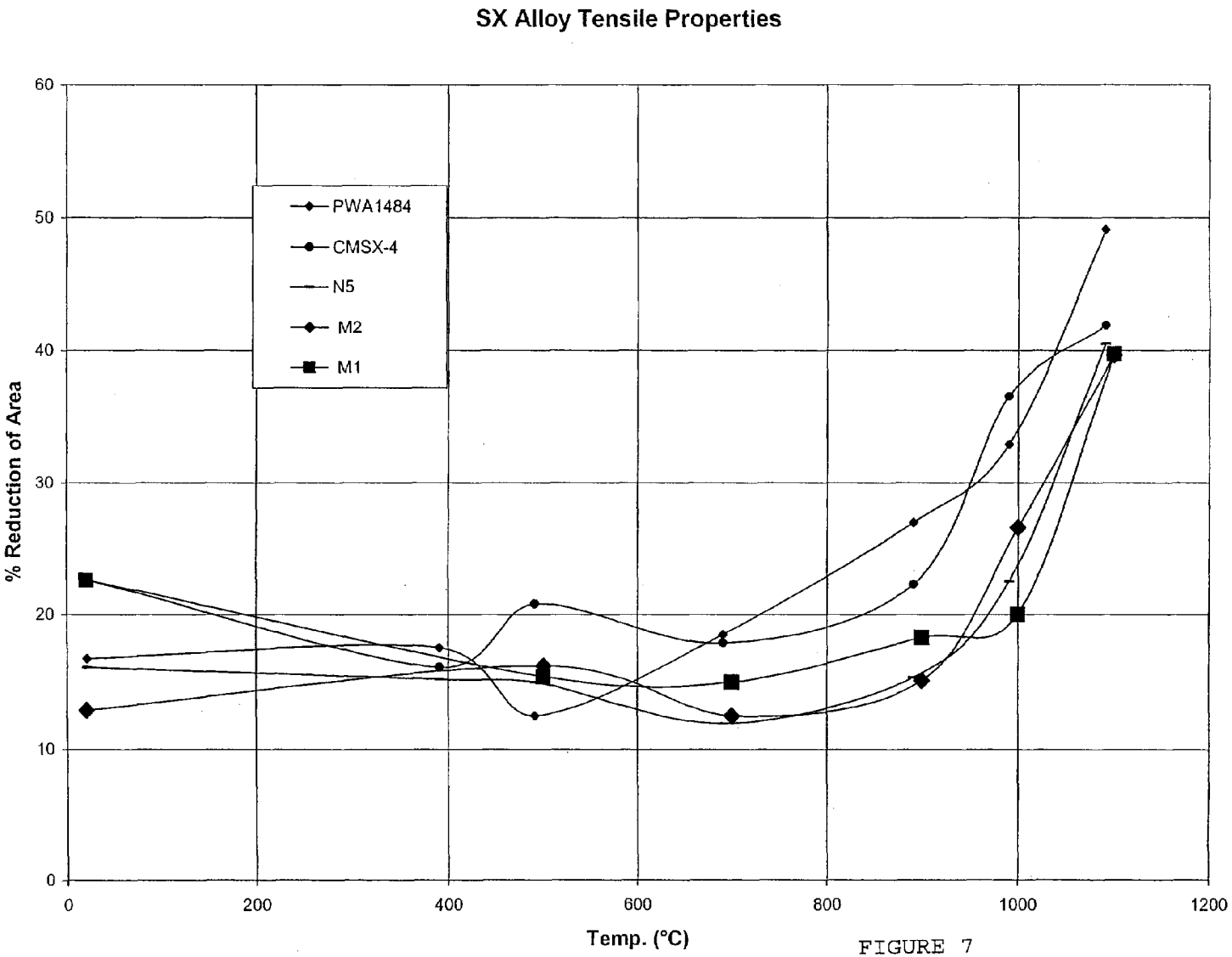
FIG. 7 is a graph of percent reduction in area versus temperature for CMSX-M1 nickel base superalloy (designated M1) and CMSX-M2 nickel base superalloy (designated M2) pursuant to the invention and for the comparison PWA 1484, N5, and CMSX-4 nickel base superalloys.

FIG. 3 is a bar graph comparing the stress rupture lives for the CMSX-M1 and CMSX-M2 nickel base superalloys pursuant to the invention and the comparison PWA 1484, N5, and CMSX-4 nickel base superalloys. It is apparent that the CMSX-4 M1 nickel base superalloy (designated M1) pursuant to the invention exhibited a dramatic increase in stress rupture life compared to the comparison N5 nickel base superalloy (designated C) and CMSX-4 nickel base superalloy (designated B) under all testing conditions and was generally equivalent in stress rupture life to the comparison PWA 1484 nickel base superalloy (designated C) at lower temperatures and higher stress levels (e.g. 791° C./825 MPa and 891° C./550 MPa) and better than the comparison PWA 1484 nickel base superalloy at higher temperatures and lower stress levels (e.g. 991° C./275 MPa and 1091° C./150 MPa).

Referring to FIGS. 4, 5, 6, and 7, the tensile testing data is shown for the CMSX-M1 and CMSX-M2 nickel base superalloys pursuant to the invention and the comparison PWA 1484, N5, and CMSX-4 nickel base superalloys. It is apparent that the CMSX-M1 and M2 nickel base superalloys pursuant to the invention are comparable to the comparison nickel base superalloys in tensile strength (e.g. ultimate tensile strength-UTS and 0.20% yield stress-0.2%YS), elongation, and reduction of area over the temperatures tested (e.g. room temperature to 1100° C.).

The CMSX-M1 and CMSX-M2 nickel base superalloys pursuant to the invention exhibited reduced casting scale and reduced non-metallic inclusions as a result of the inclusion of the carbon concentrations of 200 ppm and 400 ppm, respectively. For example, the CMSX-M1 and CMSX-M2 nickel base superalloy investment cast test bars pursuant to the invention had reduced casting scale and reduced non-metallic inclusion levels as compared to the comparison CMSX-4 nickel base superalloy and exhibited improved castability from the standpoint that vacuum investment cast test bars of CMSX-M1 and CMSX-M2 exhibited less exterior scale as compared to vacuum investment cast test bars of the comparison CMSX-4 nickel base superalloy.

Although the invention has been shown and described with respect to detailed embodiments thereof, it will be understood by those skilled in the art that various changes in form and detail thereof may be made without departing from the spirit and scope of the claimed invention.

We claim:

1. Single crystal casting comprising a nickel base superalloy having improved stress rupture life at an elevated temperature above 1400 degrees F., consisting essentially of, in weight %, about 6.4% to about 6.8% Cr, about 9.3% to about 10.0% Co, 7.0% to about 8.5% Ta, about 5.45% to about 5.75% Al, about 6.2% to about 6.6% W, about 0.5% to about 0.7% Mo, about 0.8% to about 1.2% Ti, about 2.8% to about 3.2% Re, up to about 0.12% Hf, about 0.01% to about 0.08% C, up to about 0.10% B, and balance Ni and incidental impurities.

2. The casting of claim 1 having a C content of about 0.02% to about 0.04% by weight of the superalloy.

3. The casting of any one of claims 1-2 including at least one of yttrium, cerium, and lanthanum in an amount up to about 0.01 weight %.

4. A turbine airfoil comprising the single crystal casting of any one of claims 1-2.

5. The turbine airfoil casting of claim 4 which is a single crystal cast airfoil.

* * * * *